US008468900B2

(12) United States Patent
Warhurst

(10) Patent No.: US 8,468,900 B2
(45) Date of Patent: Jun. 25, 2013

(54) PIPETTE TIP POSITIONING FOR MANUALLY-DIRECTED, MULTI-CHANNEL ELECTRONIC PIPETTOR

(75) Inventor: Julian Warhurst, Ashland, MA (US)

(73) Assignee: Integra Biosciences Corp., Hudson, NH (US)

( * ) Notice: Subject to any disclaimer, the term of this patent is extended or adjusted under 35 U.S.C. 154(b) by 91 days.

(21) Appl. No.: 13/099,854

(22) Filed: May 3, 2011

(65) Prior Publication Data

US 2011/0296931 A1 Dec. 8, 2011

Related U.S. Application Data

(60) Provisional application No. 61/330,551, filed on May 3, 2010.

(51) Int. Cl.
*B01L 3/02* (2006.01)

(52) U.S. Cl.
USPC ..... 73/864.25

(58) Field of Classification Search
None
See application file for complete search history.

(56) References Cited

U.S. PATENT DOCUMENTS

| | | | | |
|---|---|---|---|---|
| 5,116,180 | A | 5/1992 | Fung et al. | |
| 6,360,792 | B1 | 3/2002 | Ganz et al. | |
| 6,601,433 | B2 * | 8/2003 | Kriz et al. | 73/1.74 |
| 6,982,063 | B2 | 1/2006 | Hamel et al. | |
| 7,540,205 | B2 | 6/2009 | Nelson et al. | |
| 7,662,343 | B2 | 2/2010 | Mathus et al. | |
| 7,662,344 | B2 | 2/2010 | Mathus et al. | |
| 8,033,188 | B2 | 10/2011 | Kalmakis et al. | |
| 2005/0249635 | A1 | 11/2005 | Okun et al. | |
| 2006/0048846 | A1 | 3/2006 | Roenneburg | |
| 2007/0221684 | A1 | 9/2007 | Steinbrenner et al. | |
| 2009/0074622 | A1 | 3/2009 | Kalamakis et al. | |
| 2009/0274587 | A1 | 11/2009 | Butz et al. | |
| 2011/0160909 | A1 * | 6/2011 | Glauser et al. | 700/264 |
| 2011/0268627 | A1 | 11/2011 | Warhurst et al. | |
| 2011/0268628 | A1 | 11/2011 | Warhurst | |

FOREIGN PATENT DOCUMENTS

WO 2009/130318 10/2009

OTHER PUBLICATIONS

Rainin Pipetting 360° Simultaneous 96-well pipetting, Fast manual benchtop system, 2009 Rainin Instrument, LLC, PB-210 LIQ RevB, 2 pgs.
Rainin Pipetting 360° Liquidator 96, Manual benchtop pipetting system, 2008 Rainin Instrument, LLC, 9920-360 Rev. B, 16 pgs.
CyBi—Well Pipettor User Manual, Release Sep. 2008, 88 pgs.
Thermo Scientific Matrix Hydra II, Product Specification, 2008 Thermo Fisher Scientific, Inc., 2 pgs.
Thermo Scientific Matrix PlateMate 2×3, Product Specification, 2007 Thermo Fisher Scientific, Inc., 2 pgs.
Thermo Scientific Matrix PlateMate Plus, Product Specification, 2007 Thermo Fisher Scientific, Inc., 2 pgs.
International Preliminary Report on Patentability, International Patent Application No. PCT/US2011/034973, dated Nov. 6, 2012.

* cited by examiner

*Primary Examiner* — Robert R Raevis
(74) *Attorney, Agent, or Firm* — Andrus, Sceales, Starke & Sawall, LLP

(57) ABSTRACT

A manually directed, multi-channel electronic pipettor includes a software biasing mode to assure proper alignment over wells in the 96-well plate and the 384-well plate. The system also includes manual repositioning levers for nesting receptacles which are customized for 96 well-plates and 384 well-plates respectively.

22 Claims, 6 Drawing Sheets

PIPETTE TIP POSITIONING FOR MANUALLY-DIRECTED, MULTI-CHANNEL ELECTRONIC PIPETTOR

FIELD OF THE INVENTION

The invention relates to a manually directed, electronic pipetting system having a pipetting head with a plurality of pipetting channels, e.g., 96-channels, arranged in an array of rows and columns. In particular, the invention pertains to methods of positioning the pipetting head for simultaneous aspiration and dispensing of liquid samples and reagents from multi well-plates.

BACKGROUND OF THE INVENTION

The assignee of the present application has filed a co-pending patent application entitled "Manually-Directed, Electronic Multi-Channel Electronic Pipetting System", which was filed on even date herewith, by Julian Warhurst, Gary Nelson and Richard Cote, is based on U.S. Provisional Application No. 61/330,541, filed on May 3, 2010, and is herein incorporated by reference. The assignee has also filed another co-pending patent application entitled "Unintended Motion Control for Manually Directed Multi-Channel Electronic Pipettor, which was filed on even date herewith, by Julian Warhurst and Richard Cote, is based on U.S. Provisional Application No. 61/3340,545, filed on May 3, 2010, and is also incorporated by reference herein. The present invention pertains to a manually directed, multi-channel electronic pipettor as well, and in particular to features of the motion control system that facilitate precise positioning of the multi-channel pipetting head and the disposable pipette tips for aspiration and dispensing of liquid samples and reagents into and from an array of wells in a wellplate.

As is known in the art, a multi-well plate is a flat plate with multiple wells used as individual test tubes. The most common multi well-plates include 96-wells or 384-wells arranged in a rectangular matrix. ANSI has set standardized dimensions and SBS footprints for well-plates. For example, 96-well plate has eight rows and twelve columns of wells centered 9 mm centerline-to-centerline. A typical 384-well plate includes sixteen rows and twenty-four columns of wells with a centerline-to-centerline distance of 4.5 mm. Multi-well-plates with 1536-wells, and higher, are also available. Some multi well-plates are designed to hold larger volumes than the standard multi well-plate, yet maintain the standard centerline-to-centerline dimensions. These well-plates are commonly called deep well-plates. For purposes herein, the term multi-well plate to refer to both standard multi well-plates and deep well-plates. Assignee's manually-directed, electronic multi-channel pipetting system, as described in the above incorporated patent applications, is designed to transfer liquid samples from an array of wells in a standard multi-well plate or deep wellplate, or from a reagent reservoir to an array of wells in another standard wellplate or deep wellplate.

One of the advantages of the assignee's manually directed, electronic multi-channel pipetting system is the ability of the user to move the pipetting head, and hence the disposable pipette tips, in response to pressure exerted on the control handle. This feature of operation is significantly different than the operation of fully automated, high-throughput liquid handling systems. The multi-channel pipetting head in the assignee's manually directed system is mounted to a movable carriage that is attached to a tower. A deck having preferably two wellplate nesting receptacles is located in front of the tower and is accessible by the pipetting head. The tower contains a drive system to raise and lower the pipetting head to aspirate and dispense reagents and samples in the well-plates or reservoirs set in the nesting receptacles on the deck. The system also includes a drive system to move the tower, as well as the pipetting head, in a horizontal or X-axis direction. The control handle is preferably mounted to a load cell attached to the pipetting head, although it may be mounted in various other positions on the laboratory bench. The load cell detects force exerted on the control handle and outputs corresponding signals to the electronic motion control system. In use, the user grabs the control handle in a manner similar to when using a hand-held electronic pipettor. The user exerts pressure on the control handle and in turn the load cell transmits signals to the electronic motion control system to move the multi-channel pipetting head relative to the well-plates and reservoirs on the deck. As mentioned, in the preferred embodiment, a motorized vertical drive mechanism raises and lowers the pipetting head with respect to the wellplate deck and a motorized horizontal drive mechanism moves the tower and the pipetting head laterally, both in response to sensed force exerted on the control handle. If the user presses the control handle from left to right, the tower along with the pipetting head moves from left to right. If the user pulls the control handle upward or pushes downward on the control handle, the vertical drive mechanism raises or lowers the pipetting head accordingly.

The control handle and menu-driven software programming interface is quite similar to the control handle and programming interface on assignee's hand-held electronic pipettors, see e.g., U.S. Pat. No. 7,540,205, issuing Jun. 2, 2009, entitled "Electronic Pipettor", based on application Ser. No. 11/856,231 by Gary E. Nelson, George P. Kalmakis, Kenneth Steiner, Joel Novak, Jonathon Finger, and Rich Cote, filed on Sep. 17, 2007, assigned to the assignee of the present application and incorporated herein by reference; and "Pipettor Software Interface", application Ser. No. 11/856,232 by Gary Nelson, George P. Kalmakis, Gregory Mathus, Joel Novak, Kenneth Steiner and Jonathan Finger, filed Sep. 17, 2007, now U.S. Pat. No. 7,540,205, issued Jun. 2, 2009, and assigned to the assignee of the present application and incorporated herein by reference. One of the benefits of this similarity is that users which have become comfortable with the assignee's hand-held pipettors are able to easily cross-over to use the assignee's manually directed, electronic multi-channel pipetting system.

SUMMARY OF THE INVENTION

The invention pertains to a positioning system that facilitates accurate alignment of pipette tips over the wells in a wellplate placed on the deck of a manually assisted, electronic multi-channel pipetting system. As described in the above-incorporated patent applications, the preferred manually directed, electronic multi-channel pipetting system has a multi-channel pipetting head that is carried in a movable carriage. The multiple channels on the pipetting head are arranged in a two-dimensional array of rows and columns, preferably 96-channels arranged in a standard 8×12 array. The system also includes a deck that has at least two wellplate nesting receptacles adapted to hold a multi-well plate or a sample reservoir. The pipetting head is preferably mounted to a tower with the deck at the foot of the tower. The system includes a motorized Z-axis drive mechanism for raising and lowering the pipetting head with respect to the deck. It also includes the motorized X-axis drive mechanism for moving the pipetting head laterally with respect to the deck. As described in the above-incorporated patent applications, a control handle is mounted to the pipetting head carriage and the pipetting head moves in response to force applied to the control handle. The speed of the pipetting head in a given direction is generally proportional to the amount of force exerted on the control handle in the given direction as detected by a load cell.

In accordance with the invention, the movement of the pipetting head in the X-direction for purposes of aligning the multi-channel pipetting head (or in the vertical Z-axis direction to facilitate proper height location of the pipetting head) can occur either in a free form mode or in a position biasing mode. In the free form mode, the system generally allows positioning of the pipetting head in the x-direction and in the z-direction in response to user force inputs. In the biasing mode, however, the user still controls the position, but as a known wellplate position is approached, the pipetting head will tend to self-align to the center of the wells in the underlying well-plate. The biasing mode is implemented, preferably, as a position dependent software bias to the force input signals from the control handle. The biasing mode is also quite helpful for touching off the tips against the sidewall of the respective wells after dispensing. Touching off is a commonly used technique in pipetting to ensure that all of the liquid is removed from the tip when dispensing. Without the biasing mode, the accumulated force of 96 pipette tips touching off simultaneously against a wall of the wells in a well-plate can create instability.

If the user loads a 96-well plate onto the nesting receptacle on the deck, the user must first align the pipetting head and pipette tips with the 96-wells in the plate before dropping downward into the wells to aspirate or dispense. The biasing mode assists the user to properly align the pipetting channels and tips. Alignment accuracy is particularly important when aspirating or dispensing from a 384-well plate because the dimension of the wells is so much smaller than with a typical 96-well plate. If desired, the biasing mode can be activated independently for each nesting receptacle.

In the preferred version of assignee's manually directed, multi-channel electronic pipetting system, the pipetting head moves only in the X-axis horizontal and Z-axis vertical directions, and not in a Y-axis horizontal direction. Therefore, in order to accommodate aspiration and dispensing into the wells of 384 well-plates, a desired embodiment of the invention allows the nesting receptacles on the deck to be repositioned in the horizontal Y-axis direction, preferably manually. In this preferred embodiment of the invention, there are three Y-axis positions for each of the wellplate nesting receptacles on the deck, namely a 384-well A position, a 96-well position and a 384-well B position. Each of these positions is selected so that mounted pipette tips will be aligned in the y-direction with the centerline of the respective underlying well on the well-plate, assuming that the wellplate has standard dimensions. For example, when a 96-well plate is placed in a nesting receptacle positioned in the 96-well position, the tips on the pipetting head will be properly aligned in the y-direction with the centerline of the wells in the 96 well-plate. On the other hand, a 384-well plate contains 96 sets of 4 wells arranged in a 2×2 array in the x and y directions. If a 384-well plate is placed in the wellplate nesting receptacle, the receptacle is positioned in the 384-well A position to access the top two wells in the 2×2 array, and set to the 384-well B position to access the bottom two wells in the 2×2 array. The motorized X-axis drive mechanism is used to move the pipetting head in the x-direction in order to position the respective pipette tips over the selected wells in the 384-well A position or 384-well B position, as appropriate. The biasing mode as described above is preferably activated to help the user better position the pipetting head to the appropriate X-axis position to properly align the pipette tips over the appropriate wells in the 384 well-plate. Preferably the system includes a sensor that senses the Y-axis position of the nesting receptacle. If the nesting receptacle is in a 96-well position, the X-axis biasing positions will be selected for a 96 well-plate. If the Y-axis position for the nesting receptacle is set in either the 384-well A position or the 384-well B position, the biasing positions in the X direction will be set for a 384 well-plate.

The biasing mode can also be implemented in the vertical Z-axis direction in order to facilitate proper height location of the pipette tips during the pipetting routine. This and other aspects, and advantages of the invention will be apparent to those of ordinary skill in the art upon reviewing the following drawings and description thereof.

DETAILED DESCRIPTION

Figure 1:
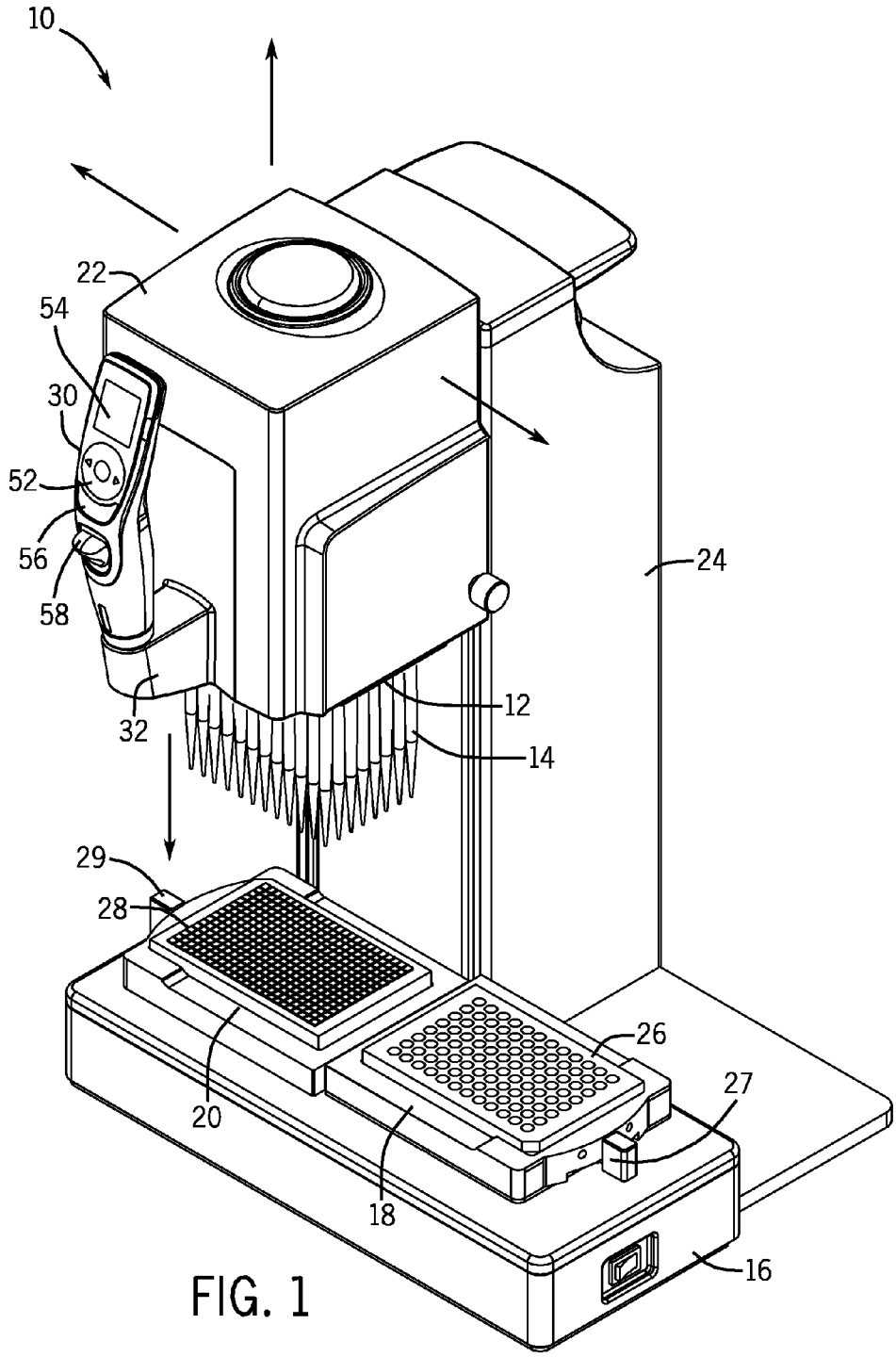
FIG. 1 is a perspective view of a manually directed, multi-channel electronic pipetting system constructed in accordance with an exemplary embodiment of the invention.
Figure 2:
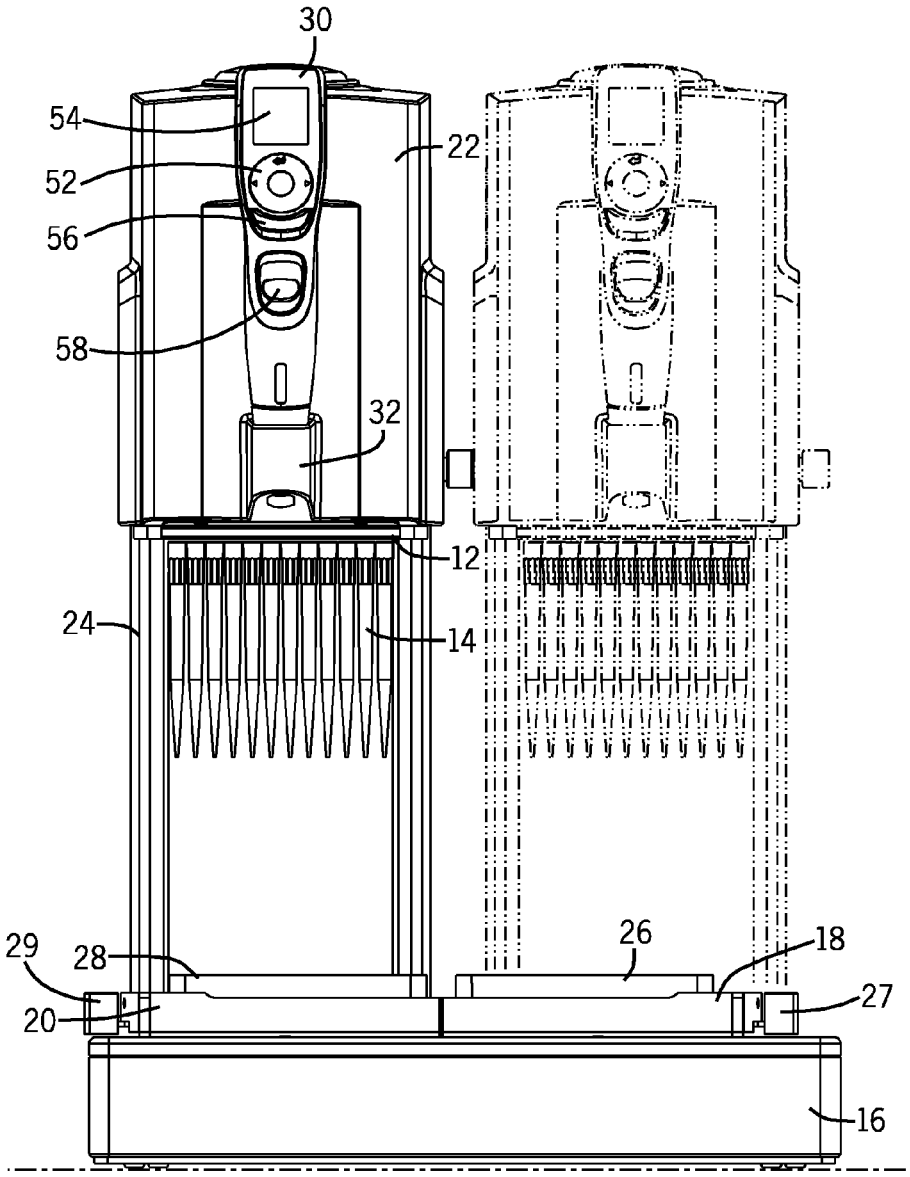
FIG. 2 is a front elevational view of the multi-channel pipetting system illustrated in FIG. 1.

An embodiment of a manually directed, multi-channel electronic pipetting system 10 as described in the above incorporated patent applications is shown in FIGS. 1 and 2. Referring to FIGS. 1 and 2, the manually directed, multi-channel electronic pipetting system 10 includes a multi-channel pipetting head 12 having a plurality of pipetting channels arranged in a two dimensional array of rows and columns. Normally, the pipetting head 12 will include an array of 96-tip fittings. An array of pipette tips 14 are attached to the multi-channel pipetting head 12. The manually directed, multi-channel electronic pipetting system 10 includes a flat deck 16 supporting a right nesting receptacle 18 and a left nesting receptacle 20. The nesting receptacles 18, 20 are designed to hold multi well-plates or reservoirs in a known location on the deck 16. In FIGS. 1 and 2, a 96-well plate 26 is located in the right nesting receptacle 18. A 384-well plate 28 is located in the left nesting receptacle 20.

The pipetting head 12 is removably mounted to a carriage 22 which in turn is mounted to a tower 24. A pipetting motor located within the carriage 22 drives the multi-channel pipetting head 12 to aspirate and dispense. A Z-axis drive mechanism moves the carriage 22 and the multi-channel pipetting 12 vertically with respect to the tower 24 and the deck 16. An X-axis drive mechanism moves the tower 24 and the carriage 22 horizontally along an X-axis so that the pipetting head 12 and the array of tips 14 can be moved from a position corresponding to the wellplate 26 in the first nesting receptacle 18 on the deck 16 to various positions corresponding to the wellplate 28 residing in the left side nesting receptacle 20.

The system 10 includes a control handle 30 preferably mounted to the carriage 22 and preferably resembling a handle for a handheld electronic pipettor. More specifically, the control handle 30 is preferably mounted to a load cell 32 that is attached to the carriage 22. In use, the user grasps the control handle 30 in the manner similar as when using a handheld pipettor, and exerts pressure on the control handle 30 to move the carriage 22 and the pipetting head 12. The vertical Z-axis motion and the horizontal X-axis motion are driven by independent motors under servo control. The control handle 30 on the load cell 32 has two pairs of strain gauges, one for vertical force distribution and one for horizontal force distribution. The X-axis drive and the Z-axis drive operate independently and contemporaneously when a component of force input is measured by each respective pair of strain gauges. The control handle 30 preferably also includes a user interface for controlling pipetting functions such as aspirating and dispensing.

The use of the controller 30 as well as the overall operation of the system 10 is intended to replicate the natural hand motion of a user using a conventional handheld pipettor. However, with a conventional handheld pipettor, a user would not be able to reliably use a 96-channel pipetting head in part because of alignment issues. It would be extremely difficult to properly align all 96 pipette tips with a detached handheld pipettor.

The manually directed, multi-channel electronic pipetting system 10 must not only be capable of transferring fluids from and to selected locations, but must also provide for the practical and convenient attachment and ejection of the pipette tips. The preferred tip attachment and ejection mechanism is disclosed in detail in the above incorporated patent applications entitled "Manually-Directed, Multi-Channel Electronic Pipetting System", U.S. patent application Ser. No. 13/099,782, filed May 3, 2011 and "Unintended Motion Control for Manually Directed Multi-Channel Electronic Pipettor", U.S. patent application Ser. No. 13/099,953, filed May 3, 2011, assigned to the assignee of the present application and incorporated herein by reference. Briefly, the pipetting head 12 with the array of tip fittings 36 is aligned precisely over the tip container using the X-axis horizontal drive mechanism. Then, the Z-axis vertical drive mechanism is used to lower the carriage 22 and the tip fittings with sufficient force to attach the array of pipette tips 14. The carriage 22 and the pipetting head 12 are then raised using the Z-axis horizontal drive mechanism to remove the tips 14 from the tip container. The tip container is removed from the nested receptacle 18 and replaced with a wellplate or reservoir in order to transfer fluids. For tip attachment as with regular motion control, the general horizontal and vertical motion of the carriage 22 and pipetting head 12 is controlled by the user by holding the controller 30 in their palm and applying pressure in the appropriate direction to position the pipetting head 12 over the tray of pipette tips 14. Precise alignment necessary for tip attachment would of course be quite difficult; however, the biasing motion control software described below facilitates precise alignment.

The preferred control handle 30 is the same or quite similar to that disclosed in issued U.S. Pat. No. 7,540,205 entitled "Electronic Pipettor" by Gary Nelson et al. issued on Jun. 2, 2009, and herein incorporated by reference. The preferred control handle 30 not only provides a handle for attachment to the load cell 32 to control movement of the pipetting head, but also preferably provides a user input interface. The control handle 30 shown in FIGS. 1 and 2 includes an elongated body adapted to be held in the hand of the user. A touch wheel control 52 is designed to be operated by the user's thumb. The touch wheel control 52 is located below a dot matrix user interface display 54. The preferred controller 30 also includes a run button 56 which is located below the touch wheel control 52 and an ejector button 58. In this exemplary embodiment, a printed circuit board with a dedicated microprocessor is located within the control handle 30, although the tower 24 contains a larger main printed circuit board that includes an additional main microprocessor. The circular touchpad 52 translates rotational movement of the user's thumb (or finger) into cursor movements on the display 54 in order to navigate menu driven software. The menu driven software is, in many respects, similar to the software disclosed in co-pending application entitled "Pipettor Software Interface", application Ser. No. 11/856,232 by George Kalmakis et al., filed Sep. 17, 2007, now U.S. Pat. No. 8,033,188, issued Oct. 11, 2011, assigned to the assignee of the present application and incorporated herein by reference. As mentioned previously, the software provides graphic displays for adjusting volume, relative pipetting speed, pace and count for the various program pipetting procedures. The software also preferably provides multiple programmable pipetting modes based on predetermined algorithms, such as pipette, repeat pipette, sample dilute, pipette/mix, manual pipette, reverse pipette, variable dispense, variable aspirate, sample dilute/mix, and serial dilution. These functional modes are based upon predetermined algorithms embedded in the software to implement respective, well known pipetting procedures, although various parameters such as volume, speed, pace, count, direction and mixing are available for programming and editing for the user. In addition, the preferred software also includes a custom programming mode in which the user can create custom pipetting procedures based on the steps of aspirating, mixing, dispensing and purging. The preferred software also includes other features as well.

While the touch wheel control 52 and the display 54 are generally used to program the pipetting system, the display 54 is also used to show progress or status during an implemented pipetting routine. In this regard, the run button 56 is used to activate the system to aspirate or dispense, etc. in accordance with the pipetting protocol on the display 54. For example, consider a situation in which the pipette tips 14 are attached to the pipetting head 12 ready for use and a reagent reservoir is placed within nesting receptacle 20 and a 96-well plate 26 with samples is placed in nesting receptacle 18, and it is desirable in accordance with a programmed protocol to transfer 20 μl of the reagent from the reservoir into each of the 96-wells in the wellplate 26. The user grasping the control handle 30 will first direct the carriage 22, pipetting head 12 and pipette tips 14 over the reservoir located in nesting receptacle 20. The display 54 may illustrate an instruction such as "aspirate 20 μl". The user will then lower the pipette tips 14 into the liquid in the reservoir by placing downward pressure on the control handle 30. Then, in order to aspirate 20 μl of the reagent into each pipette tip 14, the user will press run button 56 to activate the pipetting stepper motor to aspirate 20 μl of reagent into each pipette tip. The user will then lift the filled pipette tips 14 from the reagent reservoir by pulling upward on the control handle 30. The next instruction on the display 54 may be "dispense 20 μl". The user will then move the filled pipette tips over the wellplate 26 in the other nesting receptacle 18, and align the pipette tips over the appropriate wells in the wellplate 26 by pressing against the control handle 30. The user will then lower the filled tips over the wells, and press run button 56 to instruct the pipettor stepper motor to dispense the liquid in the pipette tips 14.

Figure 3A:
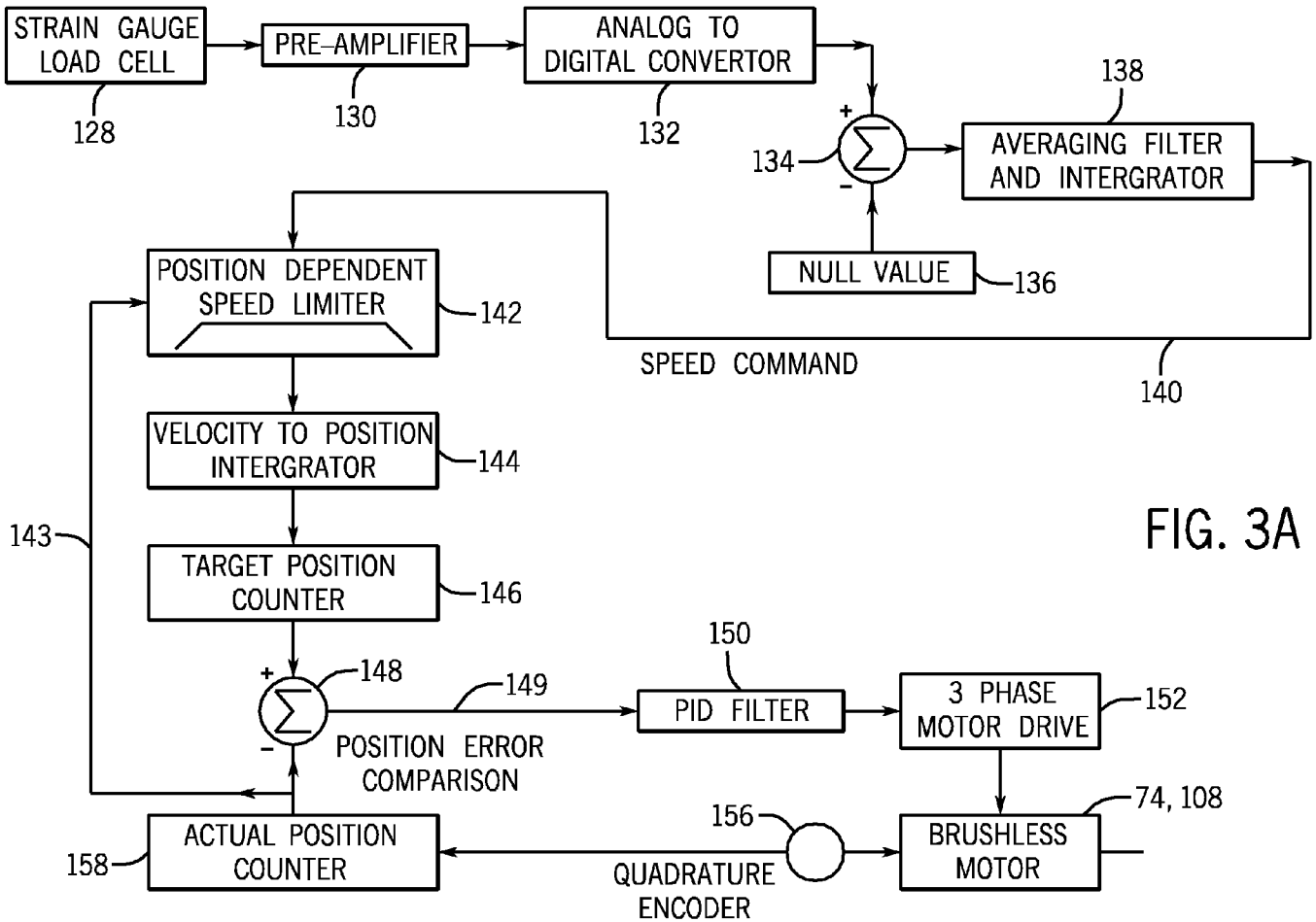
FIG. 3A is a block diagram illustrating an electromechanical and software control loop used in accordance with an exemplary embodiment of the invention.

The general aspects of the motion control system, in free form mode, are described below in connection with FIG. 3A. The servo motor 108 for horizontal movement and the servo motor 74 for vertical movement are preferably brushless 3-phase motors with encoders operated with identical and independent control loops. Both vertical motion and horizontal motion can operate simultaneously depending on the force imparted on the control handle 30. FIG. 3A illustrates the preferred control loop in free form mode, when the user imparts a force on the control handle 30. The detected horizontal component of the force as well as the detected vertical component force is characterized by the load cell 128 or a signal that is initially amplified by a pre-amplifier 130 to a level suitable for A/D conversion. The voltage signal from the pre-amplifier 130 is converted into a digital force value preferably at a rate of 100 samples/second. The digital output signal from the A/D converter 132 is then null corrected, reference number 134. The null correction feature allows the load cell output to drift over time and/or have poor initial zero output. To determine the null value 136, the user is asked to remove their hand from the control handle 30, the A/D converter output 132 is then measured, and if stable that value it is stored as the null value 136. During normal operation, the null value is subtracted from the A/D converter output 132 and the output of the null subtraction 134 is in the range of +127 to −127 with zero corresponding to no input from the user. The null correction feature is useful when the load cell 32 is overloaded due to misuse or accidental impact which may cause its "zero" value to change. Preferably, the null value will be reset whenever the system is re-initialized.

The null-corrected user force value is then passed through an averaging filter and integrator 138. The averaging filter and integrator 138 has two functions. First, since the load cell is subject to some vibration and noise during normal operation, the averaging filter 138 smoothes out the signal. Second, the integrator reduces the force that the user must impart by accumulating the force input over time. This provides the handheld controller 30 with a light feel and imparts a sensation of inertia which has been found to be desirable. The output from the averaging filter and integrator 138 is the requested speed value, line 140. The requested speed value is a speed limiting function, which is designated in FIG. 3A as block 142. The purpose of the speed limiting function 142 is to prevent crashing in the either vertical or horizontal direction at the end of the travel range. Crashing may cause damage, and also provides undesirable sensation. The requested speed value 140 is limited at the end of the mechanical travel range such that the speed is linearly reduced to zero as the end of the mechanical travel range is reached. To do this, the speed limiter 142 is updated with the actual position of the pipetting head from the encoder 156 and position counter 158 for the respective motor 74, 108. Line 143 illustrates the actual position data being fed back to the speed limiter 142. For the horizontal axis, the total travel is approximately 150 mm with the speed limiter coming into effect during the last 10 mm on either end of travel. For the vertical axis, the total travel is approximately 250 mm with the limiter coming into effect in the last 10 mm on either end of travel.

The adjusted speed value from the speed limiter 142 is then integrated, e.g. at a rate of 1 kHz, to calculate a target position, see reference numbers 144 and 146. The target position is updated, e.g. 1,000 times/second, and represents the position that the respective servo motor 74, 108 should attempt to achieve, i.e. the classic target position for an industry standard PID controller.

The actual motor position is measured by accumulating the output of the digital encoder 156 attached to the respective servo motor 74, 108, see reference number 158. The actual position is then compared to the target position, see reference number 148, and the output is a position error value in line 149. The position error value in line 149 is passed through a proportional-integral-derivative filter 150, which calculates the desired motor output power. The desired motor output power signal is then fed to a 3-phase motor driver 152 which converts the signal to a pulse width modulation signal that is amplified through a 3-phase FET bridge and then fed to the servo motor 74, 108. The result of this control loop is that the motion of the pipettor head 112 tracks the hand motion imparted by the user on the control handle 30, with a natural feel and with end travel limits imposed in a gradual matter.

Figure 4:
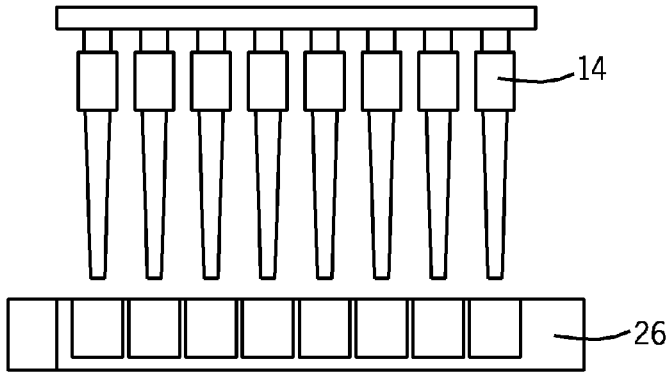
FIG. 4 is a schematic drawing illustrating pipette tips being centered over wells in the well-plate.

Use of the biasing mode during system operation is now discussed. Referring to FIG. 4, consider moving the pipettor head 12 from a plate 26 in one of the nesting receptacles 18 to another plate 28 in the other nesting receptacle 20. The user can position the pipette tips 14 over the center of the wells, or in some cases move the tips to touch the sides of the respective well to allow liquid to flow from the tip down the side of the well. In the art this is called touching off, and it helps to reduce the amount of residual liquid left within the tip when making a final dispense, and in turn improves the accuracy of the dispensed amount. Therefore, even within the dimensions of a single well in a well-plate, it is desirable that the pipetting head 12 be capable of positioning in a wide range of horizontal increments with the most common being center alignment and a small left or right deviation as shown in the touching off position in FIGS. 4A and 4B. Accurate positioning of the pipette tips in the well of a wellplate requires precise intricate positioning.

Referring to FIG. 4, positioning the pipette tips over the appropriate wells in the wellplate requires the user to move to a horizontal position within ±1 or a few mm for some of the multi well-plates that are in use today. The pipette tips may be damaged if they contact the plate with sufficient force. The weight of a 96-channel pipetting head makes it particularly easy to crash the tips into the plates. This can be frustrating for the user, and can also cause unnecessary tip replacement if the tips are damaged. To improve this situation, the motion control loop can be modified to give an artificial feel or bias when the user approaches the centerline target position. This artificial feel causes the user to feel a sensation as if a ball is falling into a hole as shown in FIGS. 4A-4B.

Figures 4A, 4B, 4C:
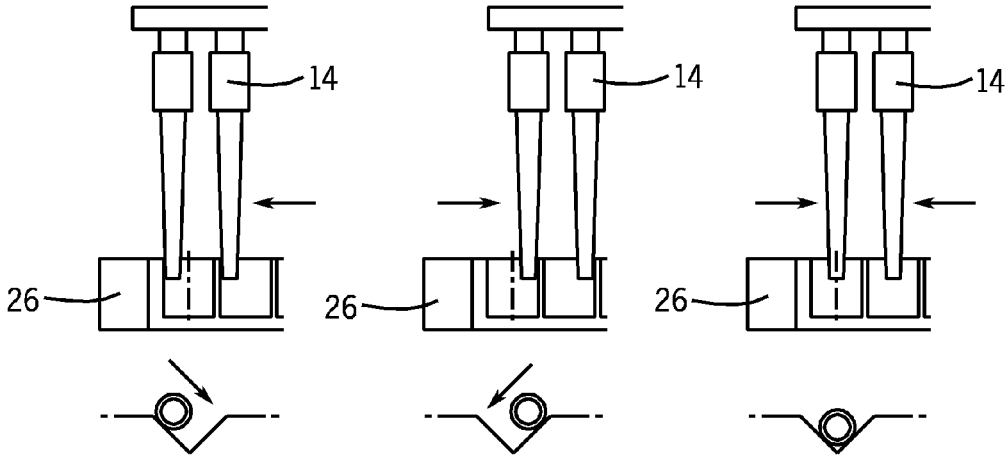
FIGS. 4A-4C schematically illustrates the concept of touching off as is accomplished in accordance with the preferred embodiment of the invention.

As the user approaches the target position over the centerline of the well, the motion controller self-centers the pipette tip over the well, see FIG. 4C. Once the pipette tip is centered over the well, light hand force inputs are insufficient to move the pipettor out of position horizontally. If the user pushes harder, the user will start to overcome the self-centering bias and will be able to perform touch off operations. In this situation the self-centering bias resisting the user enhances the user's ability to accurately touch off the pipette tips against the side of the well. This mode of motion control is referred herein as the biasing mode.

Figure 3B:
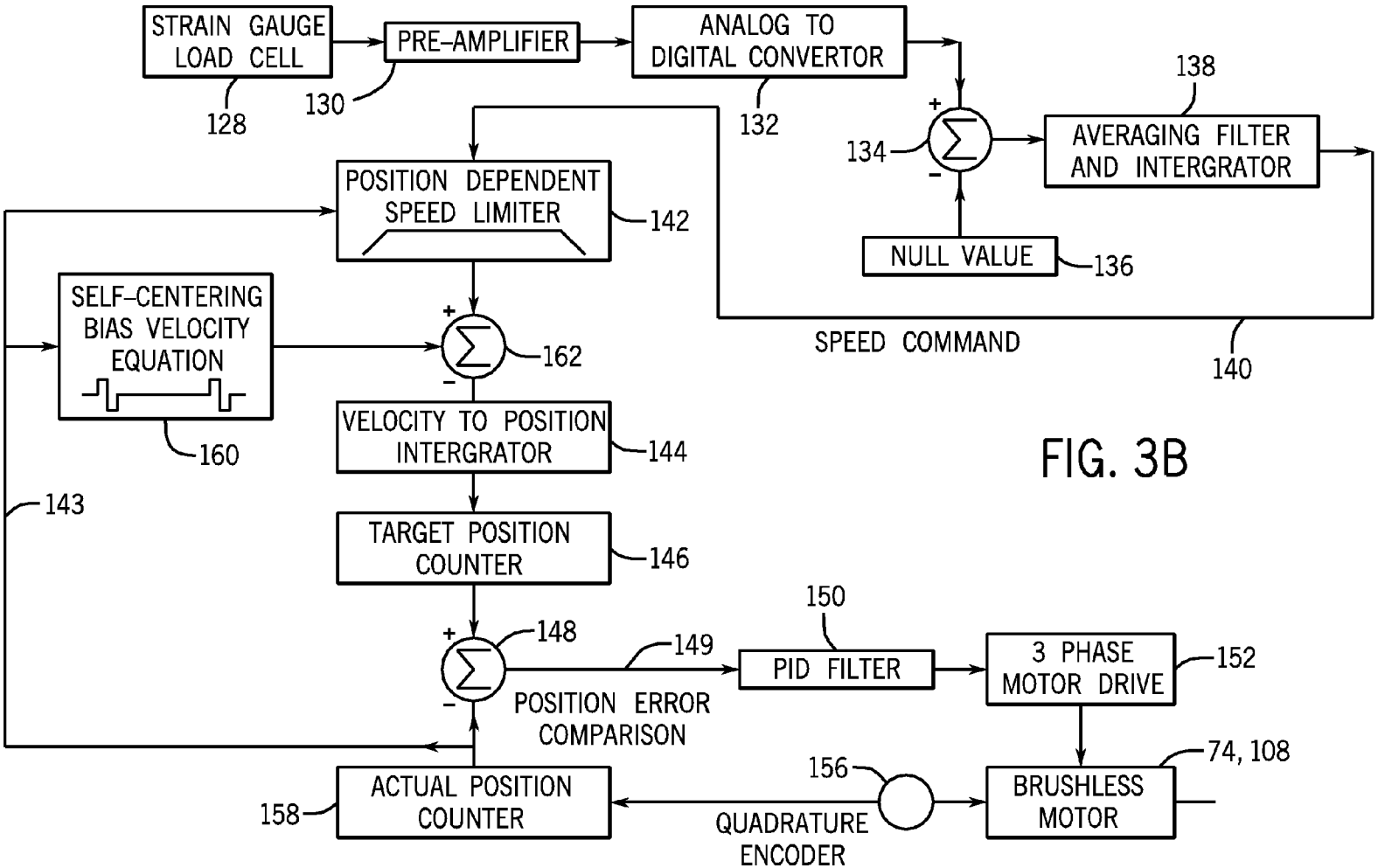
FIG. 3B is a block diagram showing an electromechanical and software control loop similar to that shown in FIG. 3, but also illustrating the use of a self-centering bias velocity equation in accordance with a preferred embodiment of the invention.

A control loop for implementing the biasing mode is shown in FIG. 3B. The control loop shown in FIG. 3B is quite similar to that shown in FIG. 3A except that it contains block 160 representing self-centering bias velocity equation, and summing junction 162 which sums the position limited speed command from block 142 with the velocity bias value from block 160.

The self-centering bias velocity algorithm contains equations that convert the horizontal position information of the pipetting head into a left or right velocity bias value. In its simplest form, there are a series of decision statements based on the distance from the center line position of the well-plates in the nesting receptacles 18 or 20:

Where:

X=current position where positive positions are to the right

Xcl=center of the left position,

Xcr=center of right position

Xh=half well width distance (4.5 mm for 9 mm wells)

S=bias velocity

Vadd=velocity to be added to the users hand controller input

Detecting within the well to the left of the left position:

If (X<Xcl) and (X>Xcl−Xh) then Vadd=S

Detecting within the well to the right of the left position:

If (X>Xcl) and (X<Xcl+Xh) then Vadd=−S

Detecting within the well to the left of the left position:

If (X<Xcr) and (X>Xcr−Xh) then Vadd=S

Detecting within the well to the right of the left position:

If (X>Xcr) and (X<Xcr+Xh) then Vadd=−S If none of these rules are true then Vadd=0

Figure 5:
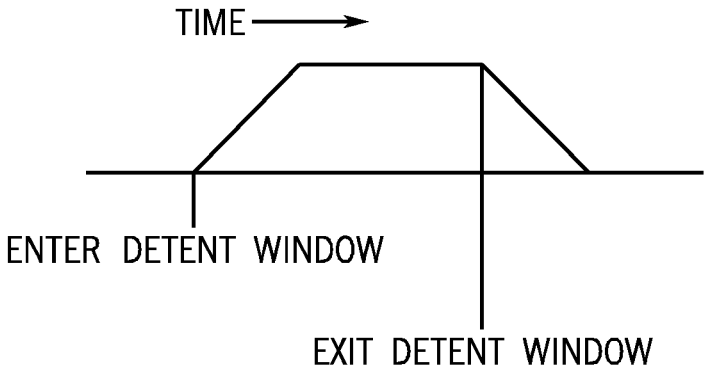
FIG. 5 is a schematic drawing illustrating the operation of an electronic time fader which is used to smooth operation of the system when in the biasing mode.

The above four rules are mutually exclusive; only one can be true at a time. These simple functions do achieve the intended effect. However, there is an undesirable effect caused by Vadd rapidly changing from +/−S to Zero when the user moves out of the well and this effect causes a noticeable "jump" in the hand controller feel. To eliminate this jump, the equations are modified to add a time delay that fades the Vadd up or down as the user enters or exits the biasing detent. The time fades is graphically depicted in FIG. 5. The time delay is a 1000 ms delay that counts up or down in 1 ms increments. If pipetting head is within the left detent (on either the left or right of center) then the time delay counts up. If not, it counts down. For example the following equations are executed every 1 ms:

```
If (X > Xcr − Hx) and (X< Xcr + Hx) then
If (FadeTImer < 1000) then FadeTimer = FadeTimer+1
    Else
If (FadeTImer > 0) then FadeTimer = FadeTimer−1
    Endif
```

The original equations are modified and the FadeTimer value is multiplied by S. In addition the default setting of S back to zero is eliminated; instead it remains at the last value:

Detecting within the well to the left of the left position:

If (X<Xcl) and (X>Xcl−Xh) then Vadd=S*FadeTimer/1000

Detecting within the well to the right of the left position:

If (X>Xcl) and (X<Xcl+Xh) then Vadd=−S*FadeTimer/1000

Detecting within the well to the left of the left position:

If (X<Xcr) and (X>Xcr−Xh) then Vadd=S*FadeTimer/1000

Detecting within the well to the right of the left position:

If (X>Xcr) and (X<Xcr+Xh) then Vadd=−S*FadeTimer/1000

Thus when the user initially moves the pipetting head within a half well width of the center of the well, the fade timer gradually counts from 0 to 1000 ms over the period of 1 second and increases the biasing velocity S gradually, avoiding an undesirable feel entering the center of a well. As the user moves the pipetting head away from the center of the well, it passes beyond a half well width and the fade times start to count down. The biasing velocity gradually decreases, which avoids the undesirable feel leaving the center of the well.

Although described above with respect to biasing with respect position along the X-axis, biasing can also be accomplished in the vertical Z-axis in generally the same manner.

Figure 6:
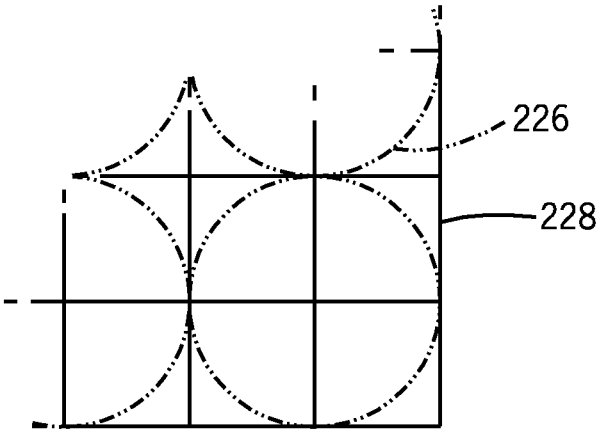
FIG. 6 is a schematic drawing illustrating the geometric differences between a 96-well plate and a 384-well plate.

Referring now to FIGS. 6 and 1, the nesting receptacles 18, 20 can each be independently positioned in the Y-axis horizontal direction. The Y-axis horizontal direction is orthogonal to the Z-axis vertical direction and to the X-axis horizontal direction in which the pipetting head 12 and carriage 22 move with respect to the deck 16. Preferably, a lever 27, 29 on each of the nesting receptacles 18, 20 is used to manually reposition the nesting receptacles in one of three Y-axes locations. The three Y-axes locations comprise a 96-well position, and a 384-well A position and a 384-well B position. When the nesting receptacle 18 is located in the 96-well position (as is receptacle 18 in FIG. 1), the pipette tips 14 mounted on the pipetting head 12 will align with the Y-axis centerline for each well in a 96 well-plate. The spacing between wells in a 96-well plate is 9 mm. The spacing between wells in a 384-well plate is 4.5 mm. As illustrated in FIG. 6, each well (phantom) in a 96-well plate 226 corresponds generally to a group of four wells in a 384-well plate 228. The 384-well A position for the nesting receptacle repositions the nesting receptacle 20 so that the top row of wells in a 384-well plate will align along the Y-axis with the pipette tips on the pipetting head 12. The 384-well B position corresponds to the position in which the second row of wells in the 384-well plate align along the Y-axis with pipette tips on the pipetting head 12. In FIG. 1, nesting receptacle 20 is in the 384-well b position. An array of 96-pipette tips on the pipetting head 12 can therefore access all of the wells in a B well-plate.

In order to transfer fluid from wells in a 96-well plate 26 in the right side nesting receptacle 18 to the wells in a 384-well plate 28 on the other nesting receptacle 20, the user would first set the right side nesting receptacle 18 with the 96-well plate in the 96-well plate position using lever 27. Then the user would exert force on the control handle to move the pipetting head over the 96-well plate 26 to approximately align the channels in the pipetting head with the wells in the 96 well-plate. If the biasing mode is activated, the motion control system will bias the X-axis position of the pipetting head 12 towards a predetermined X-axis position in which the 96-channels on the pipetting head 12 are accurately aligned over the 96-wells in the wellplate 26 set in the right side nesting receptacle 18. The user will then use the control handle 30 to lower the carriage 22 so that the pipette tips reside within the liquid in the wells of the 96-well plate 26, and operate the controller 30 to aspirate a desired amount of liquid into the array of pipette tips 14. The user will then exert force on the control handle 30 to move the pipetting head 12 upward and over towards the 384-well plate 28 located on the other nesting receptacle 20 on the deck 16. Before dispensing, the user will set the nesting receptacle 20 to the 384-well A position or the 384-well B position. Then, the user will continue to exert force on the control handle 30 in the X-axis direction to move the 96-channel pipetting head 12 into approximate alignment over a first set of 96-wells in the 384 well-plate, e.g. a first quadrant. The control system will bias the X-axis position of the pipetting head 12 automatically to a predetermined X-axis position in which the 96-channels on the pipetting head are precisely aligned with a first set of 96-wells in the 384 well-plate. The user will then dispense a desired amount of sample or reagent into the first set of wells. The user will then use the control handle 30 to move the 96-pipette tips from the first set of 96-wells in the 384-well plate over to a second set of 96-wells in the 384-well plate still corresponding to the 384-well A position for the nesting receptacle 20. Again, the biasing algorithm will help facilitate precise alignment of the 96-pipette tips over the second set of 96-wells in the 384-well plate. The user will then reposition the nesting receptacle 20 in the Y-axis direction to the other 384-well position, e.g. to the 384-well B position in order to align the 96-channels in the pipetting head 12 with a third set of 96-wells in the 384-well plate 28. Note that for this step it may not be necessary for the user to move the pipetting head in the X-axis direction. After dispensing liquid into the second and third set of 96-wells, the user will then most likely use the control handle 30 to move the pipetting head 12 in the X-axis direction to approximate alignment over a fourth set of 96-wells in the 384-well plate 28. Again, the biasing algorithm will facilitate precise alignment of the pipette tips 14 over the fourth set of 96-wells in the 384-well plate prior to dispensing the final amount of liquid in the pipette tips into the respective wells. The user may choose to touch off the tips in this fourth and final set of wells as described above with respect to FIG. 4. The specific order in which the steps are accomplished is not critical to implementing the invention.

Note that vertical biasing positions can be used to dictate preferred dispensing locations and/or preferred heights for moving the pipette tips from one well to another. As mentioned, it is preferred that the system be able to sense the position of the levers 27 and 29, and therefore provide the appropriate biasing positions depending on whether the levers 27, 29 are set for a 96-well plate or a 384-well plate. Also, the pipetting head 12 is preferably replaceable, and its exact positioning within the carriage 22 may vary from head to head. The system preferably includes sensors to signal that the pipetting head 12 has been mounted in a proper position within the carriage 22. In addition, it is desirable for the software on the system to allow the user to adjust the centerline position for a 96-well plate and/or a 384-well plate.

What is claimed is:

1. A method of aligning a multi-channel pipetting head in a manually directed electronic pipetting system, wherein the manually directed electronic pipetting system comprises:

a multi-channel pipetting head carried in a movable carriage, the multiple channels in the pipetting head being, arranged in a two-dimensional array of rows and columns;

a deck having at least two wellplate nesting receptacles adapted to hold a multi wellplate or reservoir;

a. motorized Z-axis drive mechanism for raising and lowering the pipetting head with respect to the deck;

a motorized X-axis drive mechanism for moving the pipetting head laterally with respect to the deck; and a control handle mounted such that the multi-channel pipetting head moves in response to force applied to the control handle and the speed of the pipetting head in a given direction is generally proportional to the amount of detected force exerted on the control handle in said given direction;

the method of aligning; the multi-channel pipetting head comprising the steps of:

exerting force on the control handle in a given direction to move the pipetting head in the given direction in order to move the channels on the pipetting head into approximate alignment with wells in a wellplate set within one of the wellplate nesting receptacles on the deck; and biasing the X-axis position of the pipetting head to a predetermined X-axis position.

2. The method of aligning a multi-channel pipetting head in a manually directed electronic multi-channel pipetting system as recited in claim 1 wherein the system comprises motion control software containing X-axis alignment biasing data which biases X-axis positioning of the pipetting head in part as a function of the position of the pipetting head.

3. The method of aligning a multi-channel pipetting head in a manually directed electronic multi-channel pipetting system as recited in claim wherein the system further comprises means for selectively activating the X-axis position biasing for each wellplate nesting receptacle on the deck.

4. The method of aligning a multi-channel pipetting head in a manually directed electronic multi-channel pipetting system as recited in claim 1 wherein at least one wellplate nesting receptacle on the deck can be repositioned in a Y-axis direction that is orthogonal to the Z-axis direction and X-axis direction, and the method further comprises the step of repositioning the wellplate nesting receptacle in the Y-direction prior to moving the pipetting head into approximate alignment over wells in the wellplate set within one of the wellplate nesting receptacles on the deck.

5. The method of aligning a multi-channel pipetting head in a manually directed electronic, multi-channel pipetting system as recited in claim 4 wherein the wellplate nesting receptacle may be positioned in three Y-axis locations comprising a 384-well A position, a 384-well B position and a 96-well position.

6. The method of aligning a multi-channel pipetting head in a manually directed electronic multi-channel pipetting system as recited in claim 5 further comprising the steps of:

setting a 96-well plate in one of the nesting receptacles on the deck;

positioning the nesting receptacle on the deck in the 96-well position;

exerting force on the control handle to move the pipetting head over the wellplate in the nesting receptacle to approximately align the channels in the pipetting head with the wells in the 96 well-plate;

biasing the X-axis position of the pipetting head towards a predetermined X-axis position in which the 96-channels on the pipetting head are accurately aligned with the 96-wells in the wellplate set in the nesting receptacle.

7. The method of aligning a multi-channel pipetting head in a manually directed electronic multi-channel pipetting system as recited in claim 5 further comprising the steps of:

setting a 384-well plate in one of the nesting receptacles on the deck;

positioning the nesting receptacle on the deck in the 384-well A position;

exerting force on the control handle in the X-axis direction to move the pipetting head into approximate alignment over a first set of 96 wells in the 384 well-plate; and biasing the X-axis position of the pipetting head to a predetermined X-axis position in which the 96-channels on the pipetting head are precisely aligned with the first set of 96 wells in the 384-well plate set in the nesting receptacle.

8. The method of aligning the channels in a multi-channel pipetting head in a manually directed electronic multi-channel pipetting system as recited in claim 7 further comprising the steps of:

exerting force on the control handle in the x-direction to move the pipetting heat into approximate alignment with a second set of 96 wells in the 384 well-late; and biasing the X-axis position of the pipetting head toward a predetermined X-axis position in which the 96-channels in the pipetting head are aligned precisely with a second set of 96 wells in the 384-well plate set in the nesting receptacle.

9. The method of aligning a multi-channel pipetting, head in a manually directed electronic multi-channel pipetting system as recited in claim 8 further comprising the steps of:

repositioning the nesting receptacle in the Y-axis direction into the 384-well B position in order to align the 96-channels in the pipetting head with a third set of 96 wells in the 384-well plate set in the nesting receptacle.

10. The method of aligning a multi-channel pipetting head in a manually directed electronic multi-channel pipetting system as recited in claim 9 further comprising the steps of:

exerting force on the control handle in the X-axis direction to move the pipetting head into approximate alignment over a fourth set of 96 wells in the 384-well plate set in the nesting receptacle; and biasing the X-axis position of the pipetting head toward a predetermined X-axis position in which the 96-channels on the pipetting head are aligned with the fourth set of 96-wells in the 384-well plate set in the nesting receptacle.

11. The method of aligning a multi-channel pipetting head in a manually directed electronic multi-channel pipetting system as recited in claim 7 further comprising the step of:

repositioning the nesting receptacle in the Y-axis direction into the 384 well B position in order to align the 96-wells in the pipetting head with a second set of 96 wells in the 384-well plate set in the nesting receptacle.

12. The method of aligning a multi-channel pipetting head in a manually directed electronic multi-channel pipetting system as recited in claim 11 further comprising the steps of:

exerting force on the control handle in the X-axis direction to move the pipetting head into approximate alignment over a third set of 96 wells in the 384-well plate set in the nesting receptacle; and biasing the X-axis position of the pipetting head toward a predetermined X-axis position in which the 96-channels in the pipetting head are aligned accurately over the third set of 96 wells in the 384-well plate set in the nesting receptacle.

13. The method of aligning a multi-channel pipetting head in a manually directed electronic multi-channel pipetting system as recited in claim 12 further comprising the step of repositioning the nesting receptacle in the Y-axis direction into the 384-well A position in order to align the 96-wells in the pipetting head with a fourth set of 96 wells in the 384-well plate set in the nesting receptacle.

14. A manually directed electronic multi-channel pipetting system comprising:

a multi-channel pipetting head carried in a movable carriage, the multiple-channels being arranged in a two-dimensional array of rows and columns;

a deck having at least two wellplate nesting receptacles adapted to hold a multi wellplate or reservoir;

a motorized Z-axis drive mechanism for raising and lowering the pipetting head with respect to the deck;

a motorized X-axis drive mechanism for moving the pipetting head laterally with respect to the deck;

a control handle mounted to the movable carriage;

means for moving the movable carriage and the pipetting head in response to the force applied to the control handle such that the speed of the pipetting head in a given direction is generally proportional to the amount of detected force exerted on the control handle in said given direction; and means for biasing the X-axis position of the pipetting head towards a predetermined position selected to align the multiple channels in the pipetting head over wells in a wellplate set within one of the wellplate nesting receptacles on the deck.

15. A system as recited in claim 14 further comprising means for selectively activating the X-axis position biasing means.

16. A system as recited in claim 15 wherein said selective activation means is able to selectively activate said X-axis biasing means independently for each of the wellplate nesting receptacles.

17. A system as recited in claim 14 wherein at least one of the wellplate nesting receptacles on the deck is movable in a Y-axis direction that is orthogonal to the Z-axis direction and the X-axis direction.

18. A system as recited in claim 17 wherein the well-nesting receptacle can be positioned in three Y-axis positions comprising a 384-well A position, a 384-well B position and a 96-well position.

19. A method of dispensing liquid in disposable pipette tips into wells in a wellplate set in a manually directed electronic pipetting system, wherein the manually directed electronic pipetting system comprises:

a multi-channel pipetting head carried in a movable carriage, the multiple channels in the pipetting head being arranged in a two-dimensional array of rows and columns;

a plurality of disposable pipette tips mounted to the pipetting head in order to aspirate and dispense liquid;

a deck having at least one wellplate nesting, receptacles adapted to hold a multi wellplate or reservoir;

a wellplate set within the wellplate nesting receptacle on the deck for receiving in its respective wells liquid dispensed from the disposable pipette tips;

a motorized Z-axis drive mechanism for raising, and lowering the pipetting head with respect to the deck;

a motorized X-axis drive mechanism for moving the pipetting head laterally with respect to the deck; and a control handle mounted such that the multi-channel pipetting head moves in response to force applied to the control handle and the speed of the pipetting head in a given direction is generally proportional to the amount of detected force exerted on the control handle in said given direction;

the method of dispensing liquid in the disposable pipette tips into corresponding wells in the wellplate comprising the steps of:

a) aligning the disposable pipette tips over the respective wells in the well-plate and biasing the X-position of the pipetting head to a predetermined X-axis position over the respective wells;

b) simultaneously dispensing the liquid in the respective pipette tips into the corresponding wells;

c) exerting sufficient force on the control handle in order to overcome the biasing and move the pipette tips simultaneously towards the wall of the corresponding wells in order to touch of the respective pipette tips against the well sidewalls.

20. The method of dispensing liquid from the disposable pipette tips into the respective wells of the wellplate as recited in claim 19 wherein the X-axis position of the pipetting head is biased to a predetermined X-axis position that corresponds to the centerline of the respective wells in the wellplate on the deck.

21. A method of vertically aligning a multi-channel pipetting head at a desired height, in a manually directed electronic pipetting system, wherein the manually directed electronic pipetting system comprises:

a multi-channel pipetting head carried in a movable carriage, the multi-channels in the pipetting head being arranged in a two-dimensional array of rows and columns;

a deck having at least two wellplate nesting receptacles adapted to hold a multi wellplate or reservoir;

a motorized Z-axis drive mechanism for raising and lowering the pipetting head with respect to the deck; and a control handle mounted such that the multi-channel pipetting head moves in response to force applied to the control handle and the speed of the pipetting head in a given direction is generally proportional to the amount of detected force exerted on the control handle in said given direction;

the method of vertically aligning the multi-channel pipetting head at a desired height comprising the steps of:

exciting force on the control handle in a given direction to move the pipetting head up or down towards the desired vertical position; and biasing the Z-axis position of the pipetting head to a predetermined Z-axis position.

22. The method of vertically aligning a multi-channel pipetting head as recited in claim 21 wherein the system comprises motion control software containing Z-axis alignment biasing data which biases Z-axis in positioning of the pipetting head in part as a function of the position of the pipetting head.

* * * * *